US006652318B1

(12) United States Patent
Winings et al.

(10) Patent No.: US 6,652,318 B1
(45) Date of Patent: Nov. 25, 2003

(54) CROSS-TALK CANCELING TECHNIQUE FOR HIGH SPEED ELECTRICAL CONNECTORS

(75) Inventors: Clifford L. Winings, Etters, PA (US); Joseph B. Shuey, Camp Hill, PA (US); Stefaan Hendrik Josef Sercu, Velddriel (NL); Stephen B. Smith, Mechanicsburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/155,786

(22) Filed: May 24, 2002

(51) Int. Cl.[7] ..... H01R 13/648
(52) U.S. Cl. ..... 439/608; 439/941
(58) Field of Search ..... 439/608, 941, 439/701, 609, 108

(56) References Cited

U.S. PATENT DOCUMENTS

| | | | | |
|---|---|---|---|---|
| 3,669,054 A | | 6/1972 | Desso et al. | 113/119 |
| 3,748,633 A | | 7/1973 | Lundergan | 339/217 S |
| 4,260,212 A | | 4/1981 | Ritchie et al. | 339/97 R |
| 4,288,139 A | | 9/1981 | Cobaugh et al. | 339/74 R |
| 4,776,803 A | | 10/1988 | Pretchel et al. | 439/59 |
| 5,077,893 A | | 1/1992 | Mosquera et al. | 29/882 |
| 5,174,770 A | | 12/1992 | Sasaki et al. | 439/108 |
| 5,274,918 A | | 1/1994 | Reed | 29/882 |
| 5,590,463 A | | 1/1997 | Feldman et al. | 29/844 |
| 5,609,502 A | | 3/1997 | Thumma | 439/747 |
| 5,741,144 A | | 4/1998 | Elco et al. | 439/101 |
| 5,795,191 A | | 8/1998 | Preputnick et al. | 439/608 |
| 5,961,355 A | | 10/1999 | Morlion et al. | 439/686 |
| 6,068,520 A | | 5/2000 | Winings et al. | 439/676 |
| 6,123,554 A | * | 9/2000 | Ortega et al. | 439/79 |
| 6,125,535 A | | 10/2000 | Chiou et al. | 29/883 |
| 6,146,157 A | | 11/2000 | Lenoir et al. | 439/101 |
| 6,146,203 A | | 11/2000 | Elco et al. | 439/609 |
| 6,190,213 B1 | | 2/2001 | Reichart et al. | 439/736 |
| 6,212,755 B1 | | 4/2001 | Shimada et al. | 29/527.1 |
| 6,219,913 B1 | | 4/2001 | Uchiyama | 29/883 |
| 6,220,896 B1 | * | 4/2001 | Bertoncini et al. | 439/608 |
| 6,269,539 B1 | | 8/2001 | Takahashi et al. | 29/883 |
| 6,328,602 B1 | | 12/2001 | Yamasaki et al. | 439/608 |
| 6,347,952 B1 | * | 2/2002 | Kline et al. | 439/608 |
| 6,363,607 B1 | | 4/2002 | Chen et al. | 29/883 |
| 6,379,188 B1 | * | 4/2002 | Cohen et al. | 439/608 |
| 6,409,543 B1 | * | 6/2002 | Astbury, Jr. et al. | 439/608 |
| 6,431,914 B1 | * | 8/2002 | Billman | 439/608 |
| 6,435,914 B1 | * | 8/2002 | Billman | 439/608 |
| 6,461,202 B2 | * | 10/2002 | Kline | 439/701 |
| 6,471,548 B2 | * | 10/2002 | Bertoncini et al. | 439/608 |
| 6,554,647 B1 | * | 4/2003 | Cohen et al. | 439/607 |

* cited by examiner

*Primary Examiner*—Ross Gushi
(74) *Attorney, Agent, or Firm*—Woodcock Washburn LLP

(57) ABSTRACT

A high speed electrical connector configured to reduce the incidence of cross-talk is disclosed. The connector includes a connector housing and a plurality of columns of differential contact pairs and ground contacts. Each column of differential contact pairs and ground contacts is offset from an adjacent column such that multi-active cross-talk is reduced with respect to each differential contact pair.

22 Claims, 18 Drawing Sheets

CROSS-TALK CANCELING TECHNIQUE FOR HIGH SPEED ELECTRICAL CONNECTORS

CROSS REFERENCE TO RELATED APPLICATIONS

The subject matter disclosed herein is related to the subject matter disclosed in U.S. patent application Ser. No. 10/294,966, filed Nov. 14, 2002, entitled "Cross Talk Reduction And Impedance-Matching For High Speed Electrical Connectors."

FIELD OF THE INVENTION

The invention relates in general to electrical connectors. More particularly, the invention relates to methods and apparatuses for reducing cross-talk in high speed electrical connectors.

BACKGROUND OF THE INVENTION

Electrical connectors provide signal connections between electronic devices using signal contacts. Often, the signal contacts are so closely spaced that undesirable cross-talk occurs between nearby signal contacts. Cross-talk occurs when one signal contact induces electrical interference in a nearby signal contact thereby compromising signal integrity. With electronic device miniaturization and high speed electronic communications becoming more prevalent, the reduction of cross-talk becomes a significant factor in connector design.

One method for reducing cross-talk is to provide separate shields within the connector. In this manner, the shields act to block the cross-talk from affecting nearby signal contacts. With connector space being a premium, however, shields take up valuable space within the connector that could otherwise be used for more signal contacts. Shields also reduce characteristic impedance of adjacent differential pairs, often making it difficult to achieve the desired characteristic impedance in high density connectors. In addition to spacing and impedance issues, manufacturing and inserting the connector shields increases the overall manufacturing costs associated with the connectors. Therefore, a need exists for a high speed electrical connector (one that operates above 1 Gb/s) that reduces the occurrence of cross-talk without the need for separate shielding plates.

BRIEF SUMMARY OF THE INVENTION

The invention satisfies the aforementioned need by providing a high speed connector (operating above 1 Gb/s) that prevents the incidence of multi-active cross-talk. In this manner, and in one embodiment of the invention, the differential pairs and ground contacts are arranged within the connector in such a manner so as to reduce undesirable multi-active cross-talk that occurs between the differential pairs.

In particular, and in one embodiment of the invention, a high speed electrical connector for connecting a plurality of electrical devices is disclosed. Specifically, the connector includes a connector housing and a plurality of columns of differential contact pairs disposed within the housing, each differential contact pair includes a first signal contact for transmitting a signal having a first polarity and a second signal contact for transmitting a signal having a second polarity, opposite to said first polarity. The connector also includes a plurality of ground contacts wherein a ground contact is disposed between each differential contact pair within each column of differential contact pairs and wherein each column of differential contact pairs and ground contacts is offset from an adjacent column such that multi-active cross-talk is reduced with respect to each differential contact pair.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein.

DETAILED DESCRIPTION OF THE INVENTION

Figure 1:
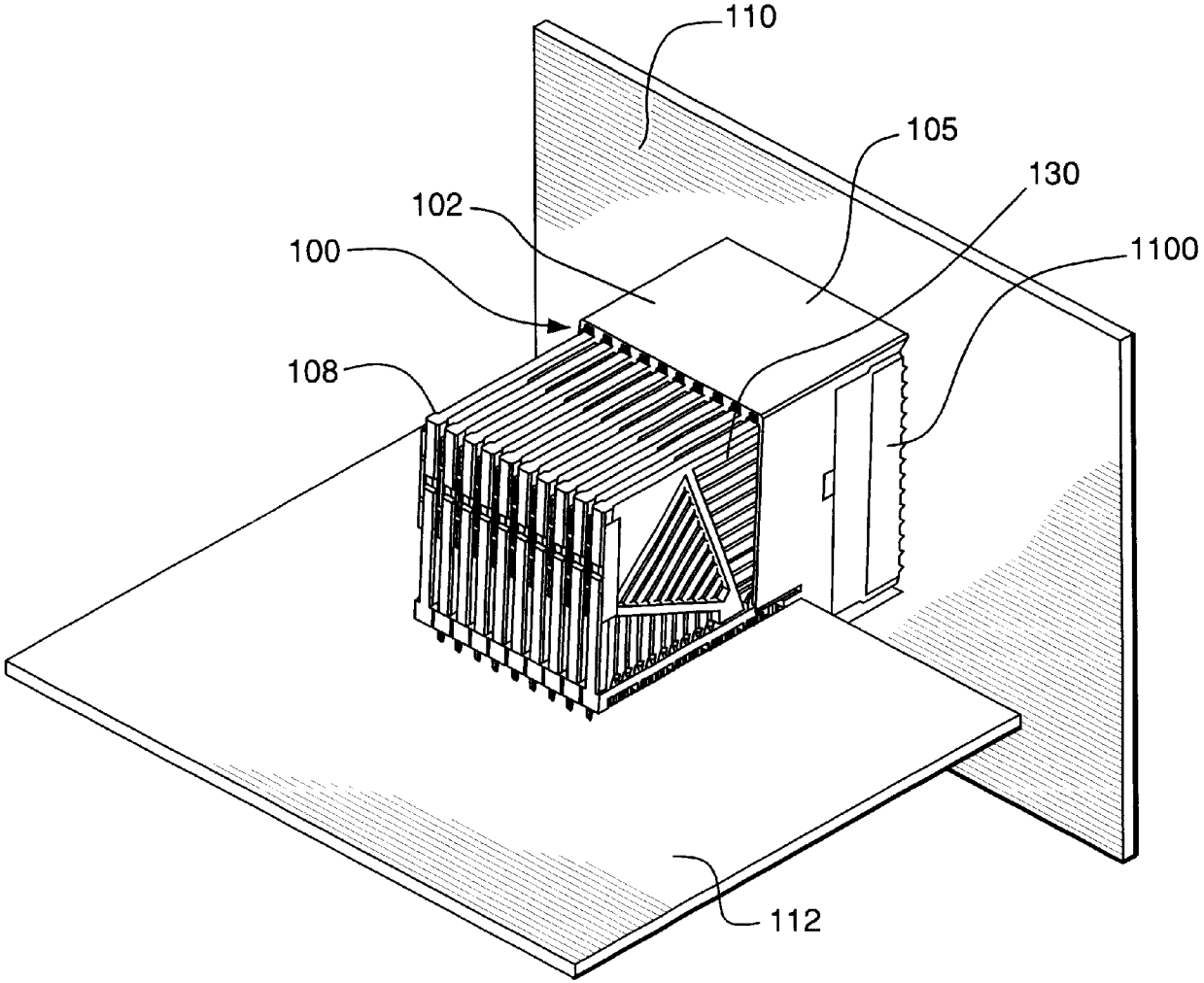
FIG. 1 is a perspective view of a backplane system having an exemplary right angle electrical connector in accordance with the invention.

FIG. 1 is a perspective view of a backplane system having an exemplary right angle electrical connector in accordance with an embodiment of the invention. However the invention may take other forms such as a vertical or horizontal electrical connector as shown in FIG. 1*b*. As shown in FIG. 1, connector 100 comprises a plug 102 and receptacle 1100.

Plug 102 comprises housing 105 and a plurality of lead assemblies 108. The housing 105 is configured to contain and align the plurality of lead assemblies 108 such that an electrical connection suitable for signal communication is made between a first electrical device 110 and a second electrical device 112 via receptacle 1100. In one embodiment of the invention, electrical device 110 is a backplane and electrical device 112 is a daughtercard. Electrical devices 110 and 112 may, however, be any electrical device without departing from the scope of the invention.

As shown, the connector 102 comprises a plurality of lead assemblies 108. Each lead assembly 108 comprises a column of terminals or conductors 130 therein as will be described below. Each lead assembly 108 comprises any number of terminals 130.

Figure 1A:
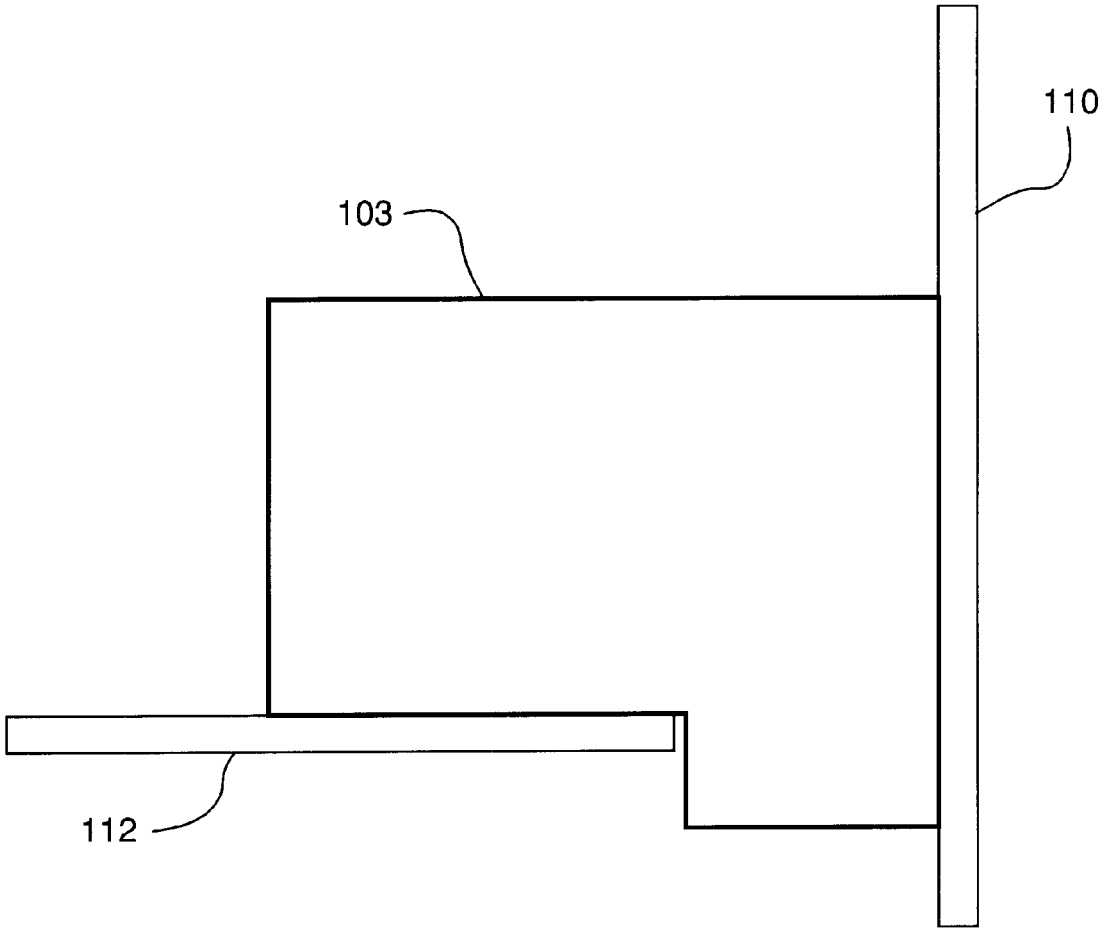
FIG. 1*a* is a simplified view of an alternative embodiment of a backplane system with a right angle electrical connector in accordance with the invention.
Figure 1B:
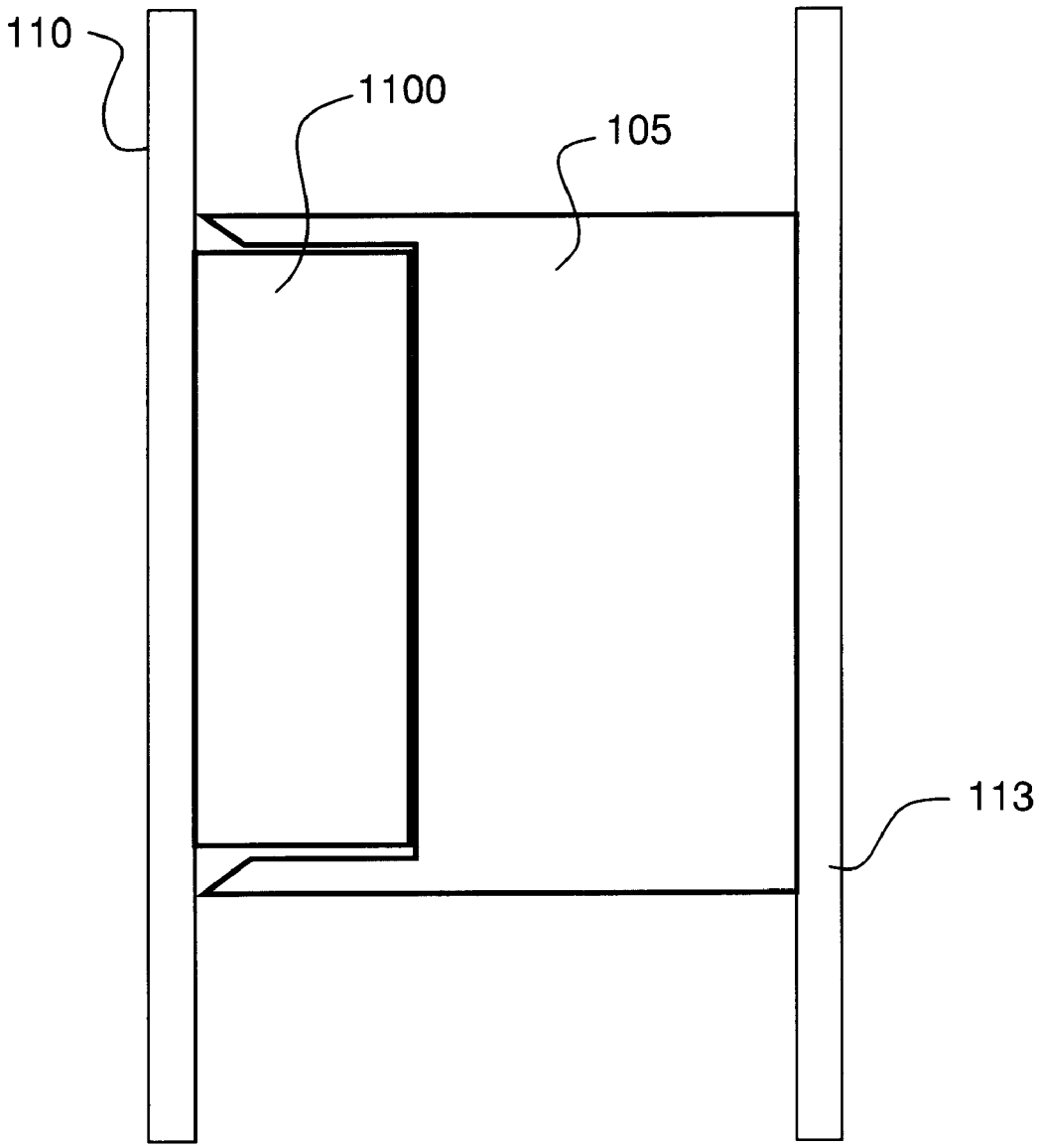
FIG. 1*b* is a simplified view of a board-to-board system having a vertical connector in accordance with the invention.

FIG. 1*a* is backplane system similar to FIG. 1 except the connector 103 is a single device rather than mating plug and receptacle. Connector 103 comprises a housing and a plurality of lead assemblies (not shown). The housing is configured to contain and align the plurality of lead assemblies (not shown) such that an electrical connection suitable for signal communication is made between a first electrical device 110 and a second electrical device 112

FIG. 1*b* is a board-to-board system similar to FIG. 1 except plug connector 105 is a vertical plug connector rather than a right angle plug connector. This embodiment makes electrical connection between two parallel electrical devices 110 and 113.

Figure 2:
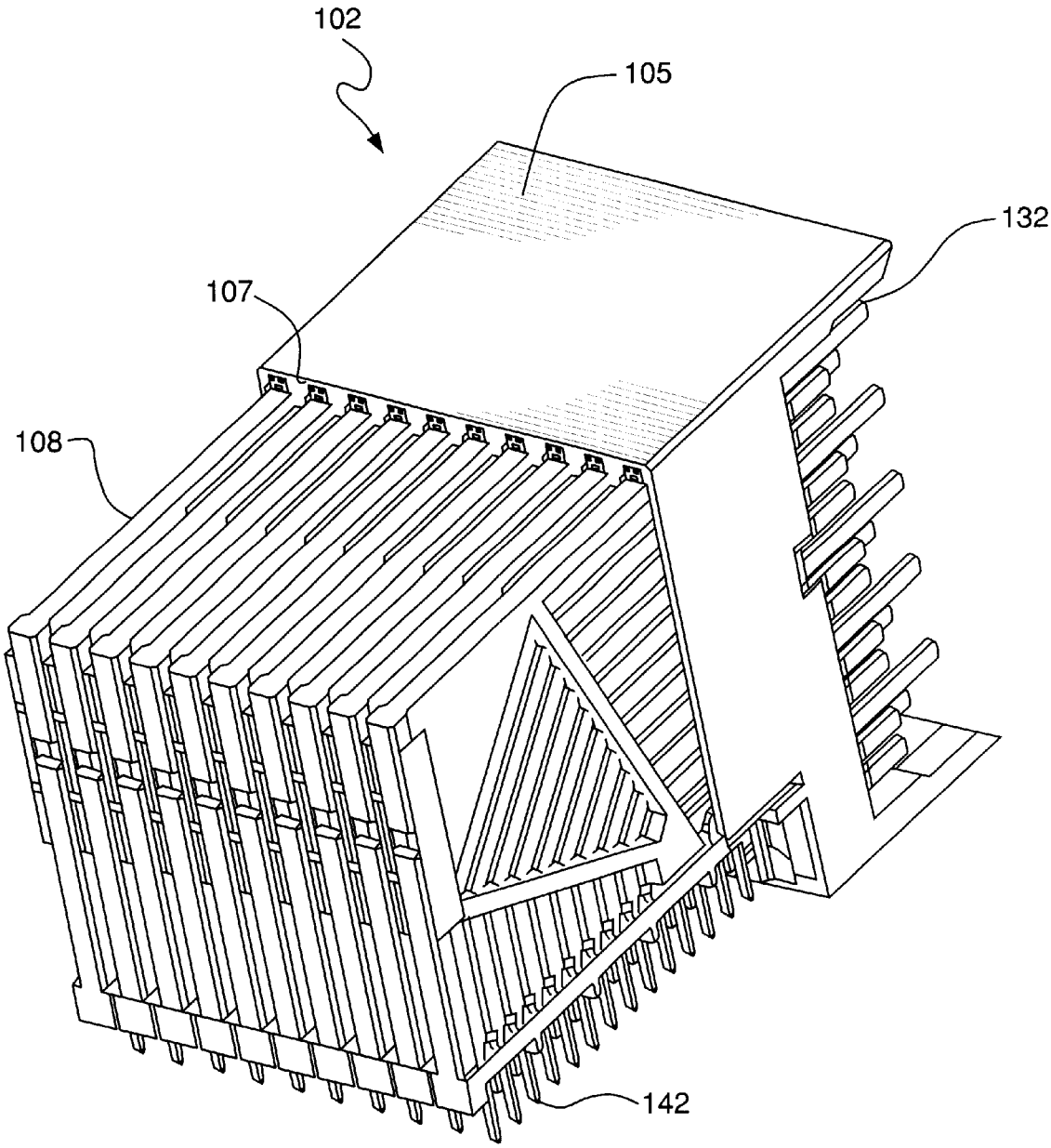
FIG. 2 is perspective view of the connector plug portion of the connector shown in FIG. 1.

FIG. 2 is a perspective view of the plug connector of FIG. 1 shown without electrical devices 110 and 112 and receptacle connector 1100. As shown, slots 107 are formed in the housing 105 that contain and align the lead assemblies 108 therein. FIG. 2 also shows connection pins 132, 142. Connection pins 142 connect connector 102 to electrical device 112. Connection pins 132 electrically connect connector 102 to electrical device 110 via receptacle 1100. Connection pins 132 and 142 may be adapted to provide through-mount or surface-mount connections to an electrical device (not shown).

In one embodiment, the housing 105 is made of plastic, however, any suitable material may be used without departing from the scope of the invention. The connections to electrical devices 110 and 112 may be surface or through mount connections without deviating from the principles of the invention.

Figure 3:
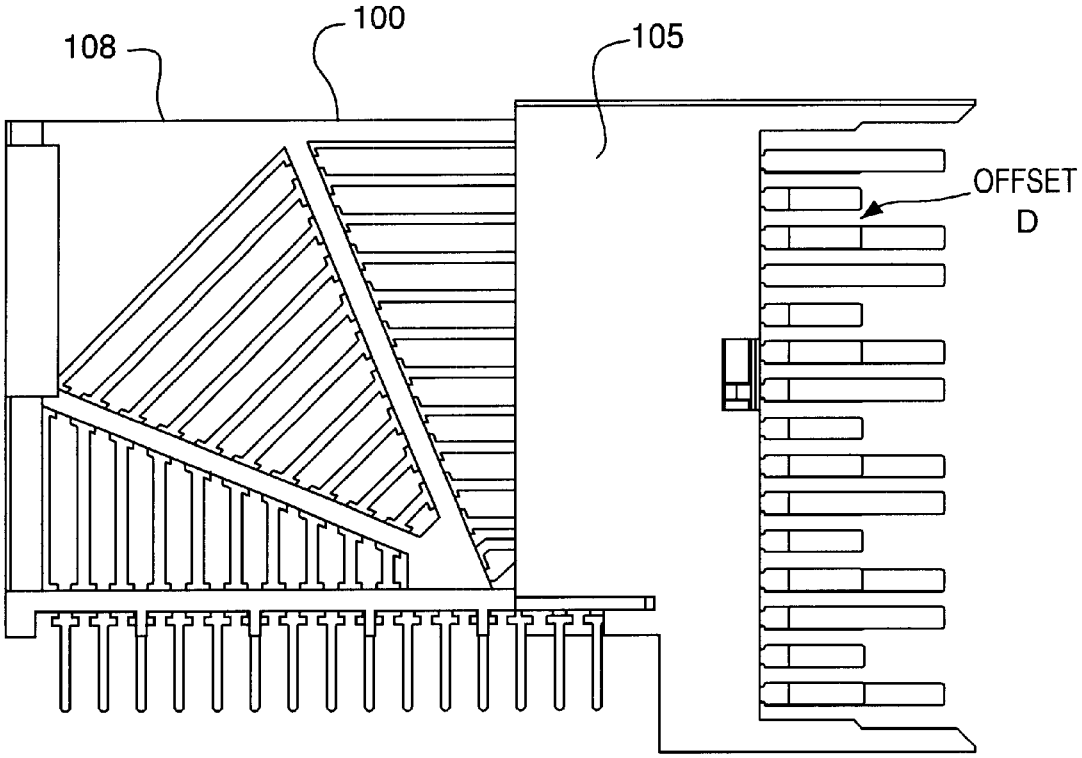
FIG. 3 is a side view of the plug connector of FIG. 2.

FIG. 3 is a side view of plug connector 102 as shown in FIG. 2. As shown, the column of terminals contained in each lead assembly 108 are offset from one another column of terminals in an adjacent lead assembly by a distance D in accordance with one aspect of the invention. Such an offset will be discussed more fully below.

Figure 4:
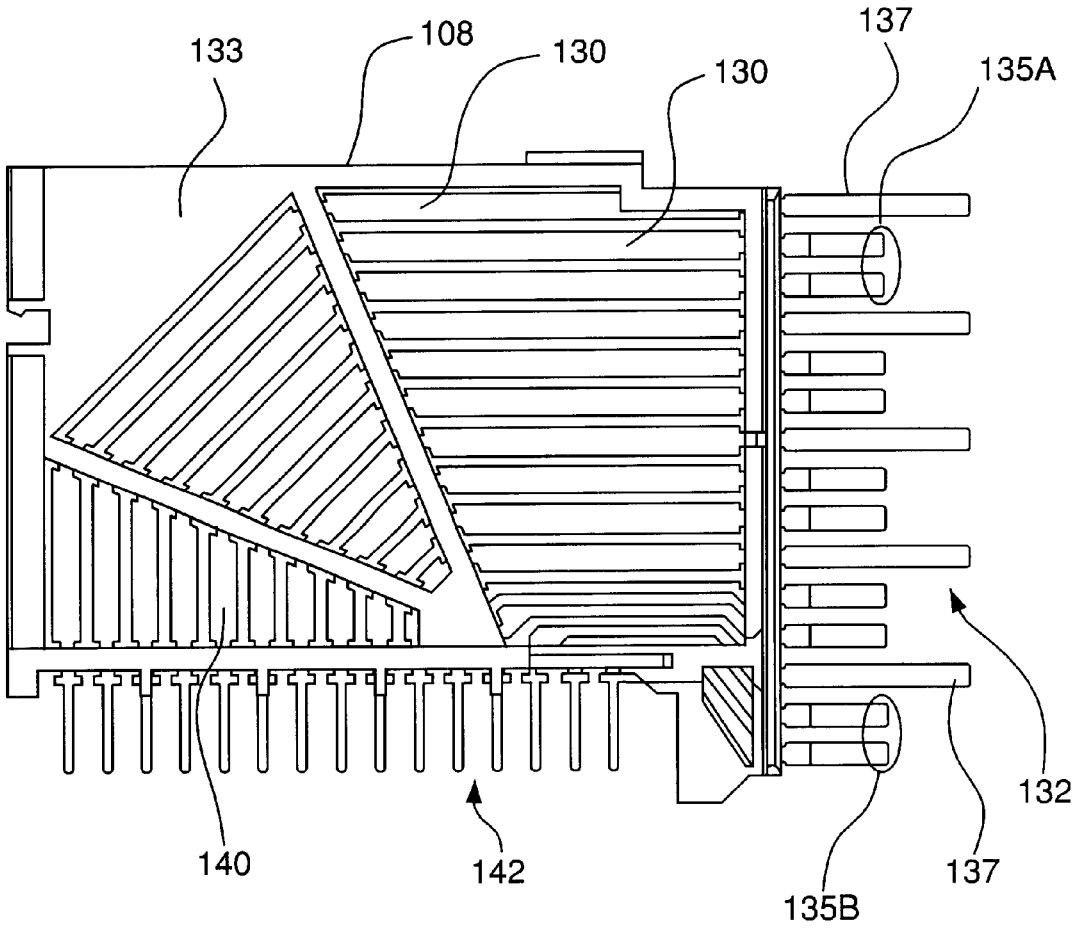
FIG. 4 is a side view of a lead assembly of the plug connector of FIG. 2.

FIG. 4 is a side view of a single lead assembly 108 not contained within housing 105. As shown in FIG. 4, one embodiment of lead assembly 108 comprises a metal lead frame 140 and an insert molded plastic frame 133. In this manner, the insert molded lead assembly 133 serves to contain one column of terminals or conductors 130. The terminals may comprise either differential pairs or ground contacts. In this manner, each lead assembly 108 comprises a column of differential pairs 135A and 135B and ground contacts 137.

Also shown in FIG. 4, and in one embodiment of the invention, the column of differential pairs and ground contacts contained in each lead assembly 108 are arranged in a signal-signal-ground configuration. In this manner, the top contact of the column of terminals in lead assembly 108 is a ground contact 137A. Adjacent to ground contact 137A is a differential pair 135A comprised of a two signal contacts, one with a positive polarity and one with a negative polarity. As shown, the ground contacts 137A and 137B extend a greater distance from the insert molded lead assembly 133. Such a configuration allows the ground to mate with receptacle 1100 before the signal contacts. Lead assembly 108 of connector 100 is shown as a right angle module. To explain, a set of first connection pins 132 is disposed on a first plane (e.g., coplanar with first electrical device 110) and a set of second connection pins 142 is disposed on a second plane (e.g., coplanar with second electrical device 112) perpendicular to the first plane. To connect the first plane to the second plane, each conductor 130 is formed to extend a total of about ninety degrees (a right angle) to electrically connect electrical devices 110 and 112.

Figure 5:
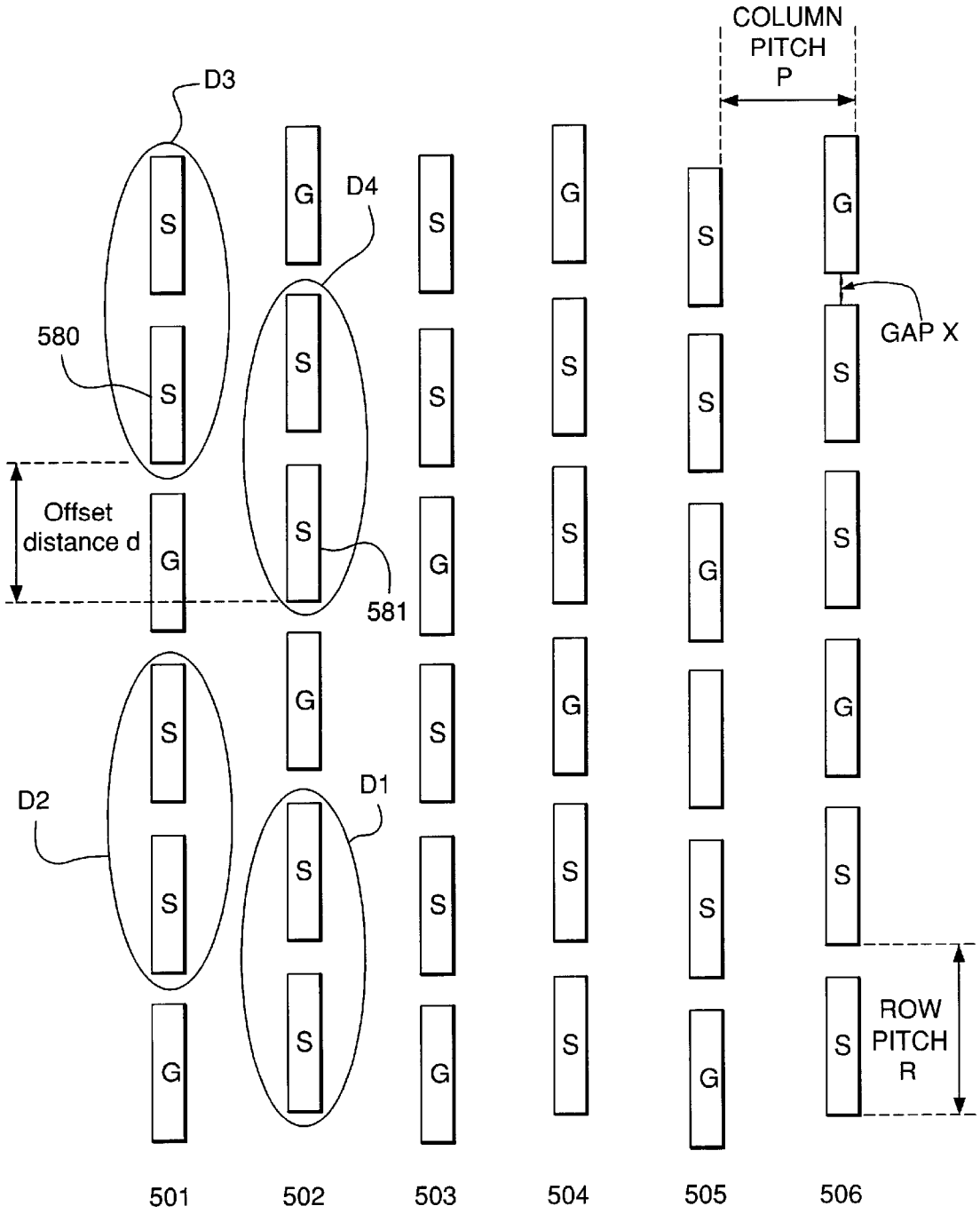
FIG. 5 is a diagram showing an array of six columns of terminals arranged in accordance with one aspect of the invention.

FIG. 5 shows an array of differential pairs and ground contacts in accordance with one aspect of the invention. In accordance with the invention, each column of terminals within the connector 100 is offset from each adjacent column of terminals. In this manner, the offset is measured from one edge of a terminal to the same edge of the corresponding terminal in the adjacent column. By offsetting the columns, any mulit-active cross talk occurring in any particular terminal is reduced. Multi-active cross talk is cross talk that occurs on a terminal from multiple sources. In this manner, the signal integrity of connector 100 is relatively high by reducing mult-active cross-talk.

As shown in FIG. 5, each column is offset from the adjacent column by a distance d. Specifically, column 501 is offset from column 502 by a distance d. Column 502 is offset from column 503 by a distance d. Column 503 is offset from column 504 by a distance d. Column 504 is offset from column 505 by a distance d. Column 505 is offset from column 506 by a distance d. Since each column is offset from the adjacent column, each terminal within the columns is offset from an adjacent terminal. For example, signal contact 580 in differential pair D3 is offset from the signal contact 581 in differential pair D4 by a distance d. The amount of offset may be half a row pitch, a full row pitch, or some other pitch factor without departing from the principles of the invention. The optimum offset depends on a number of factors, including column pitch, row pitch, the shape of the terminals, and the dielectric constant of the insulative material around the terminal.

Additionally, the aspect ratio of gap to pitch between the columns of differential pairs is less than 0.3. The aspect ratio of gap to pitch is a ratio of the distance of terminals in adjacent columns to the distance of the pitch. For example, as shown in FIG. 5, the gap is distance X and the column pitch is distance P. Consequently, the aspect ratio of gap to pitch is X/P.

Figure 6:
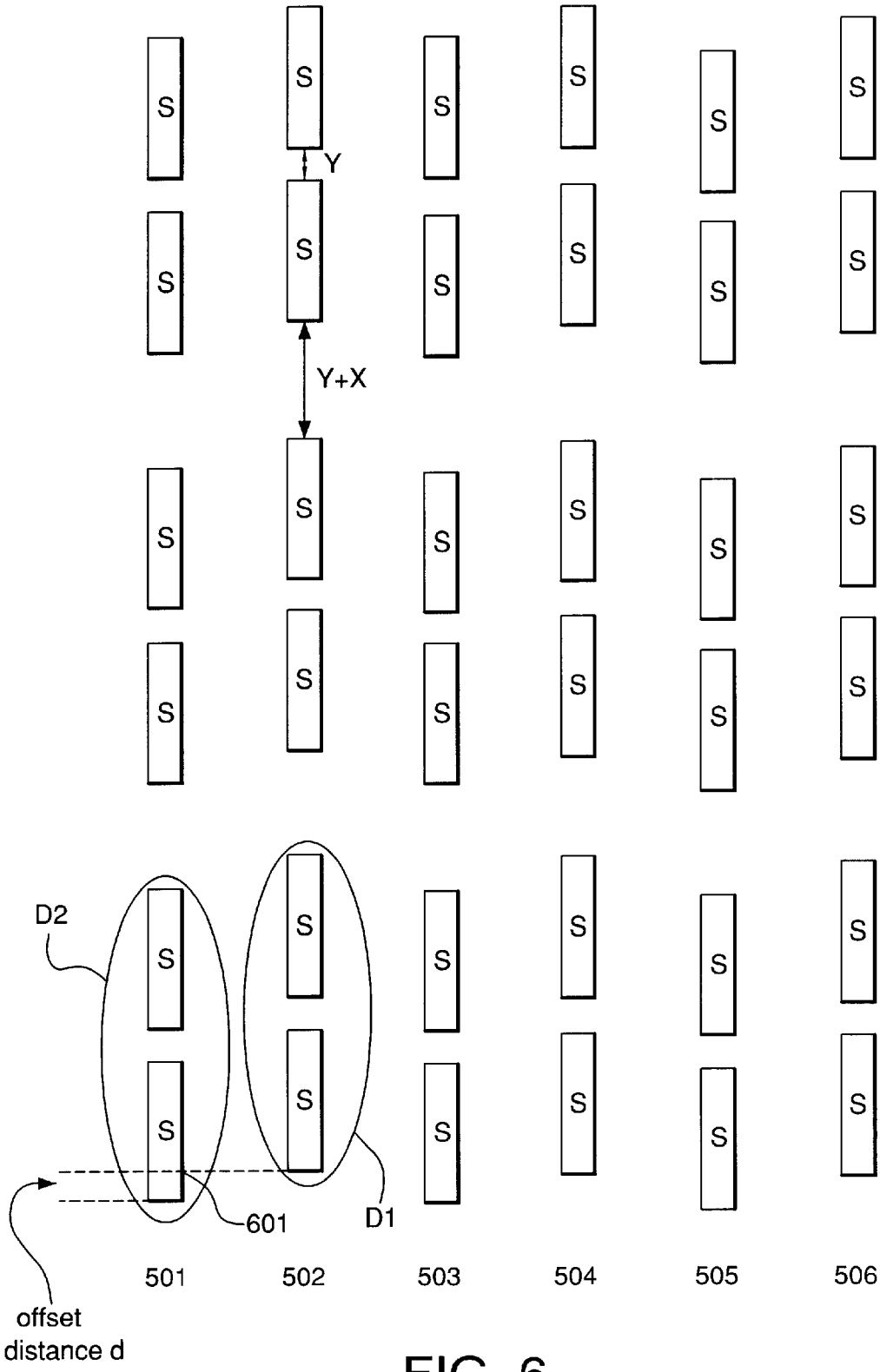
FIG. 6 is a diagram showing an array of six columns arranged in accordance with another embodiment of the invention.

FIG. 6 illustrates another configuration of differential pairs in accordance with another embodiment of the invention. In accordance with the invention, each column of terminals within the connector 100 is offset from each adjacent column. For example, as shown, differential pair D1 in column 501 is offset from differential pair D2 in the adjacent column 502 by a distance d.

In this embodiment, the array of terminals does not include a ground contact separating each differential pair. Rather, the differential pairs within each column are separated from each other by a distance greater than the distance separating one terminal in a differential pair from the second terminal in the same differential pair. For example, the distance between terminals within each differential pairs is Y and the distance separating differential pairs is Y+X. Such spacing also serves to reduce cross talk.

Figure 8:
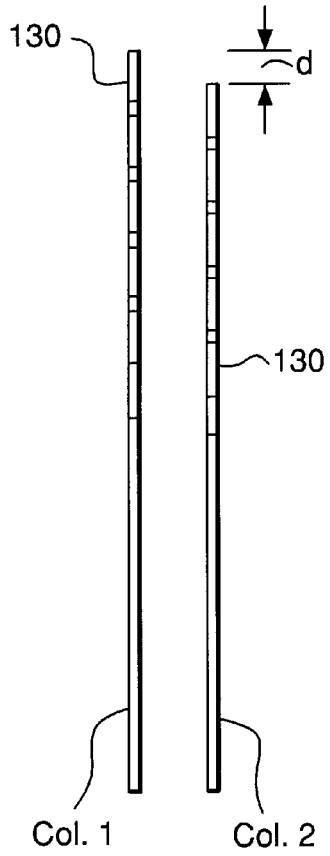
FIG. 8 is a front view of the terminals of FIG. 7.
Figure 7:
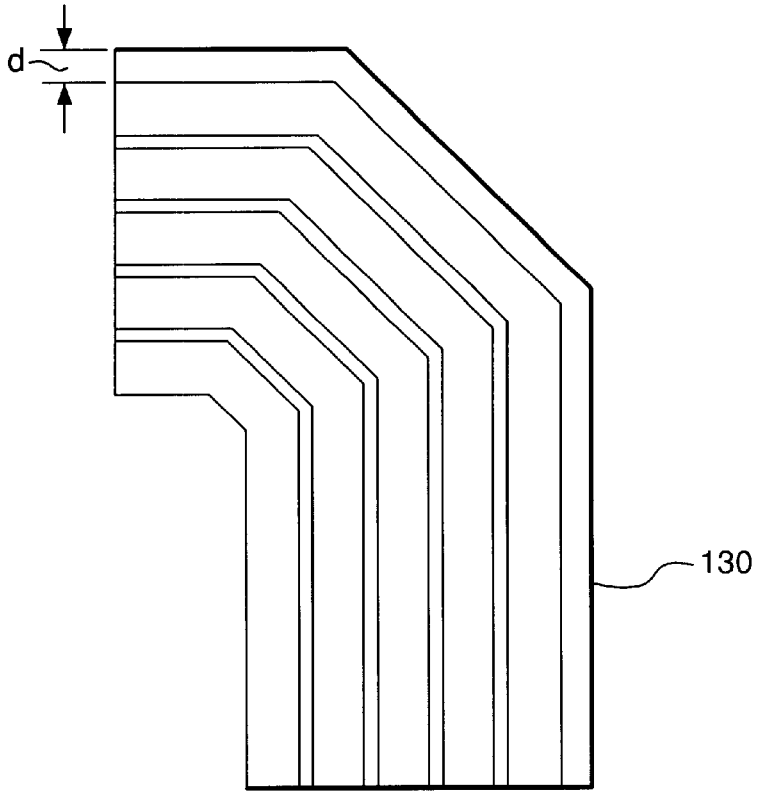
FIG. 7 is a side view of two columns of terminals in accordance with one embodiment of the invention.

FIG. 7 and FIG. 8 are side and front view, respectively, of two columns of terminals in accordance with one aspect of the invention. As shown in FIGS. 7 and 8, adjacent columns of terminals are staggered in relation to one another. In other words, an offset exists between terminals in adjacent lead assemblies. In particular and as shown in FIGS. 7 and 8, an offset of distance d exists between terminals in column 1 and terminals in column 2. As shown, the offset d runs along the entire length of the terminal. As stated above, the offset reduces the incidence of cross-talk by furthering the distance between the signal carrying contacts.

To simplify conductor placement, in the present embodiment, conductors 130 have a rectangular cross section as shown in FIG. 7. Conductors 130 may, however, be any shape without departing from the scope of the invention.

Figure 9A:
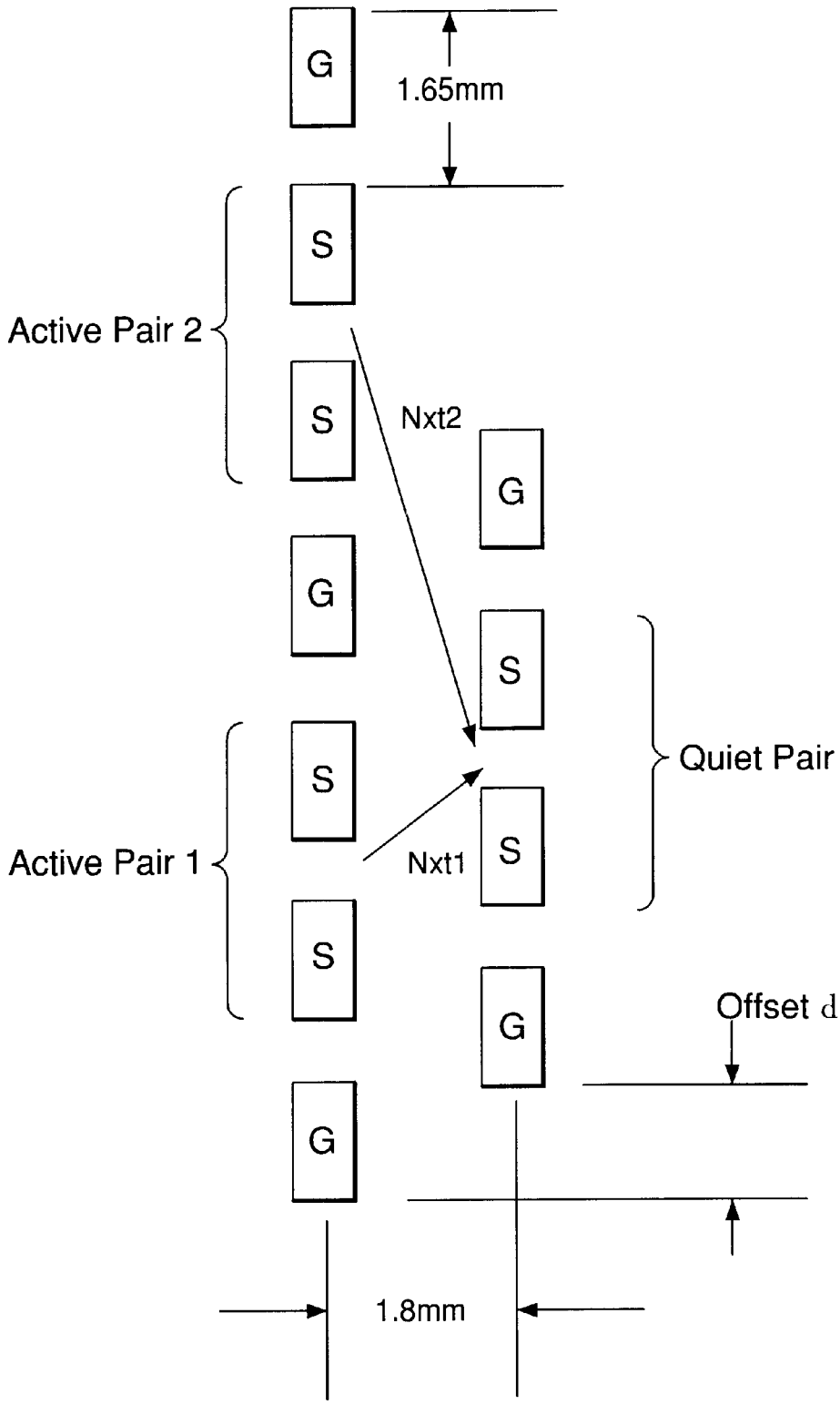
FIG. 9*a* illustrates a conductor arrangement used to measure the effect of offset on multiactive crosstalk.

FIG. 9*a* illustrates a conductor arrangement used to measure the effect of offset between adjacent columns on multiactive crosstalk. Fast (40 ps) rise-time differential signals were applied to Active Pair 1 and to Active Pair 2. Near-end crosstalk, designated Nxt1 and Nxt2 was measured on Quiet Pair as Offset dimension d was varied from 0 to 5.0 mm.

Figure 9B:
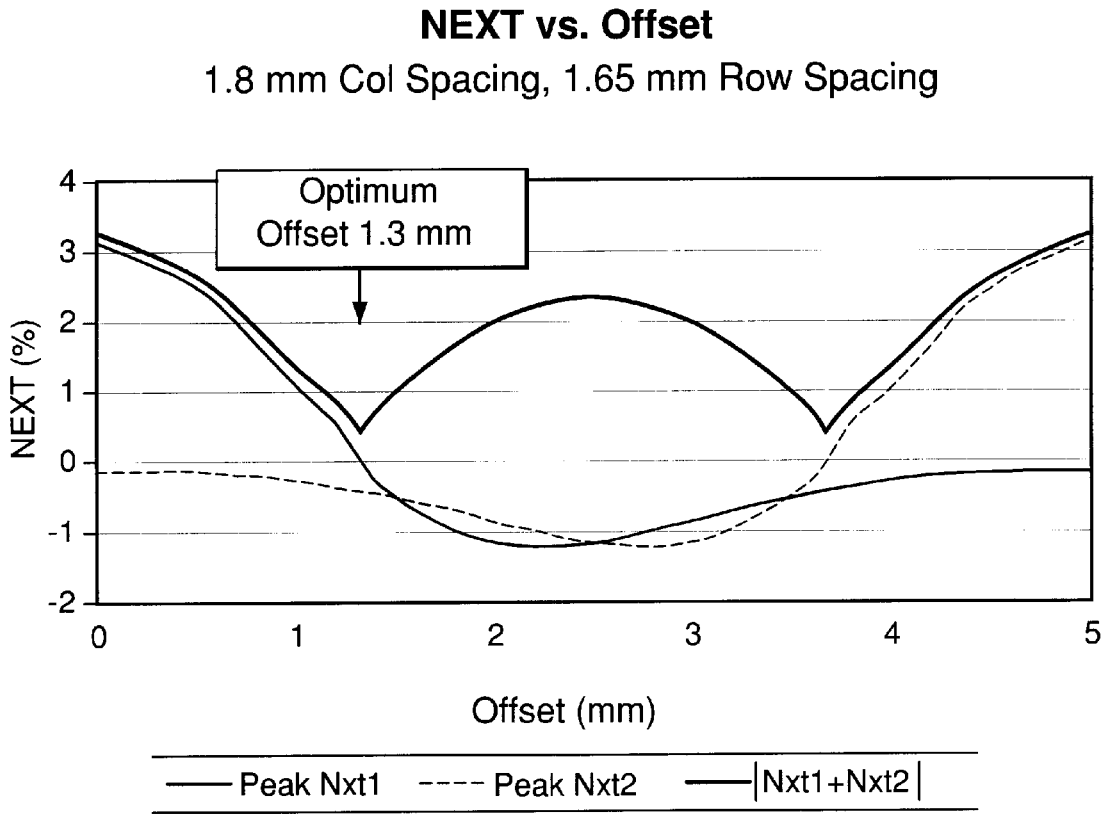
FIG. 9*b* is a graph illustrating the relationship between multiactive crosstalk and offset between adjacent columns of terminals in accordance with one aspect of the imvention.

FIG. 9*b* is a graph showing the results of these measurements. Specifically, the graph illustrates the incidence of multi-active cross-talk that occurs between differential pairs. Two differential pairs being active pairs (electrical signals applied) and the other pair being quiet (no applied signal). In this manner, cross talk occurs when noise is induced on the quiet pair from each of the current carrying conductors in the differential pair.

As shown, the lowest sum of the absolute values of crosstalk from the two active pairs, called "multi-active cross-talk", occurs when the offset is either around 1.3 mm or around 3.65 mm. In one embodiment of the invention, to minimize multi-active cross-talk, the offset between columns is 1.3 mm. Such an offset minimizes cross-talk while keeping the electrical connector relatively compact.

Figure 10:
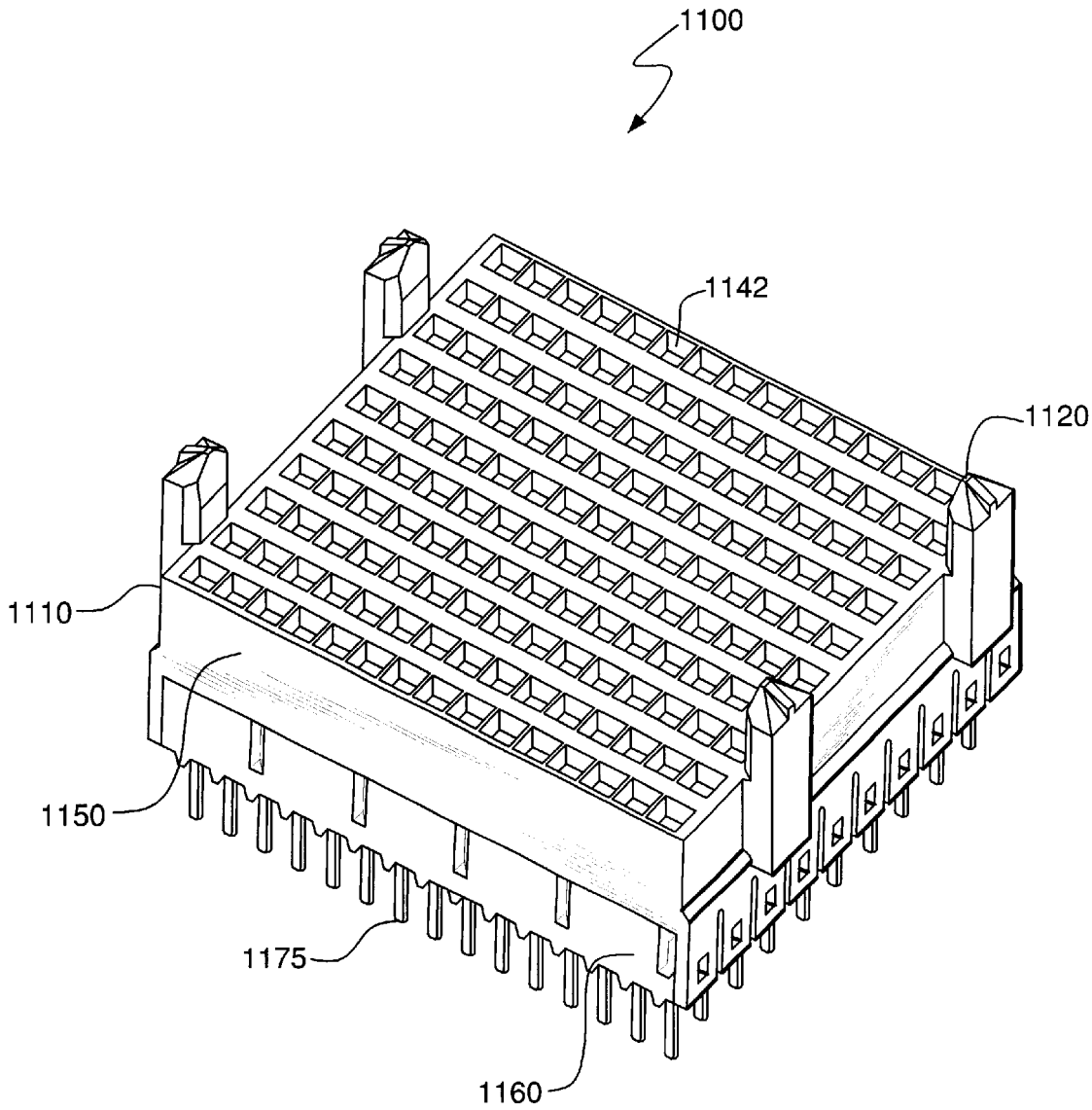
FIG. 10 is a perspective view of the receptacle portion of the connector shown in FIG. 1.

FIG. 10 is a perspective view of the receptacle portion of the connector shown in FIG. 1. In this manner, receptacle 1100 may be mated with connector plug 102 (as shown in FIG. 1) and used to connect two electrical devices (not shown). Specifically, connection pins 132 (as shown in FIG. 2) may be inserted into aperatures 1142 to electrically connect connector 102 to receptacle 1100. Receptacle 1100 also includes alignment structures 1120 to aid in the alignment and insertion of connector 100 into receptacle 1100. Once inserted, structures 1120 also serve to secure the connector once inserted into receptacle 1100. Such structures 1120 thereby prevent any movement that may occur between the connector and receptacle that could result in mechanical breakage therebetween.

Receptacle 1100 includes a plurality of receptacle contact assemblies 1160 each containing a plurality of terminals (only the tails of which are shown). The terminals provide the electrical pathway between the connector 100 and any mated electrical device (not shown).

Figure 11:
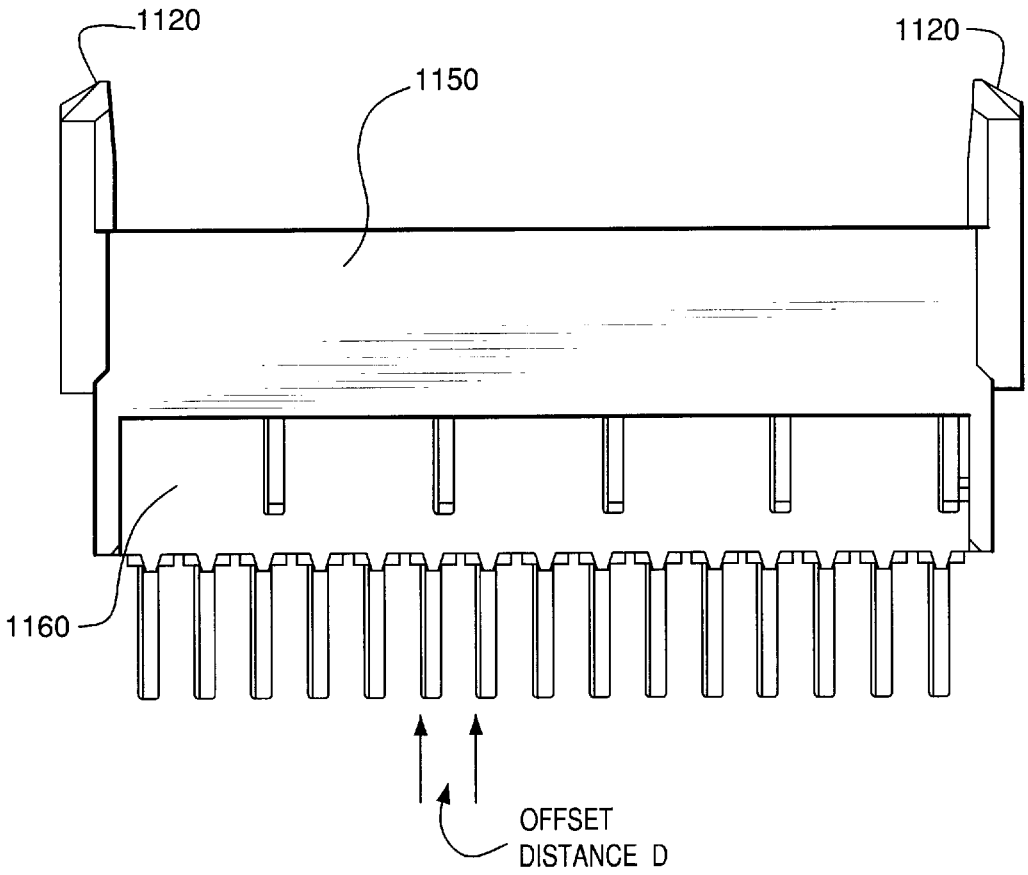
FIG. 11 is a side view of the receptacle of FIG. 10.

FIG. 11 is a side view of the receptacle of FIG. 10 including structures 1120, housing 1150 and receptacle lead assembly 1160. As shown, FIG. 11 also shows that the receptacle lead assemblies may be offset from one another in accordance with the invention. As stated above, such offset reduces the occurrence of multi-active cross talk as described above.

Figure 12:
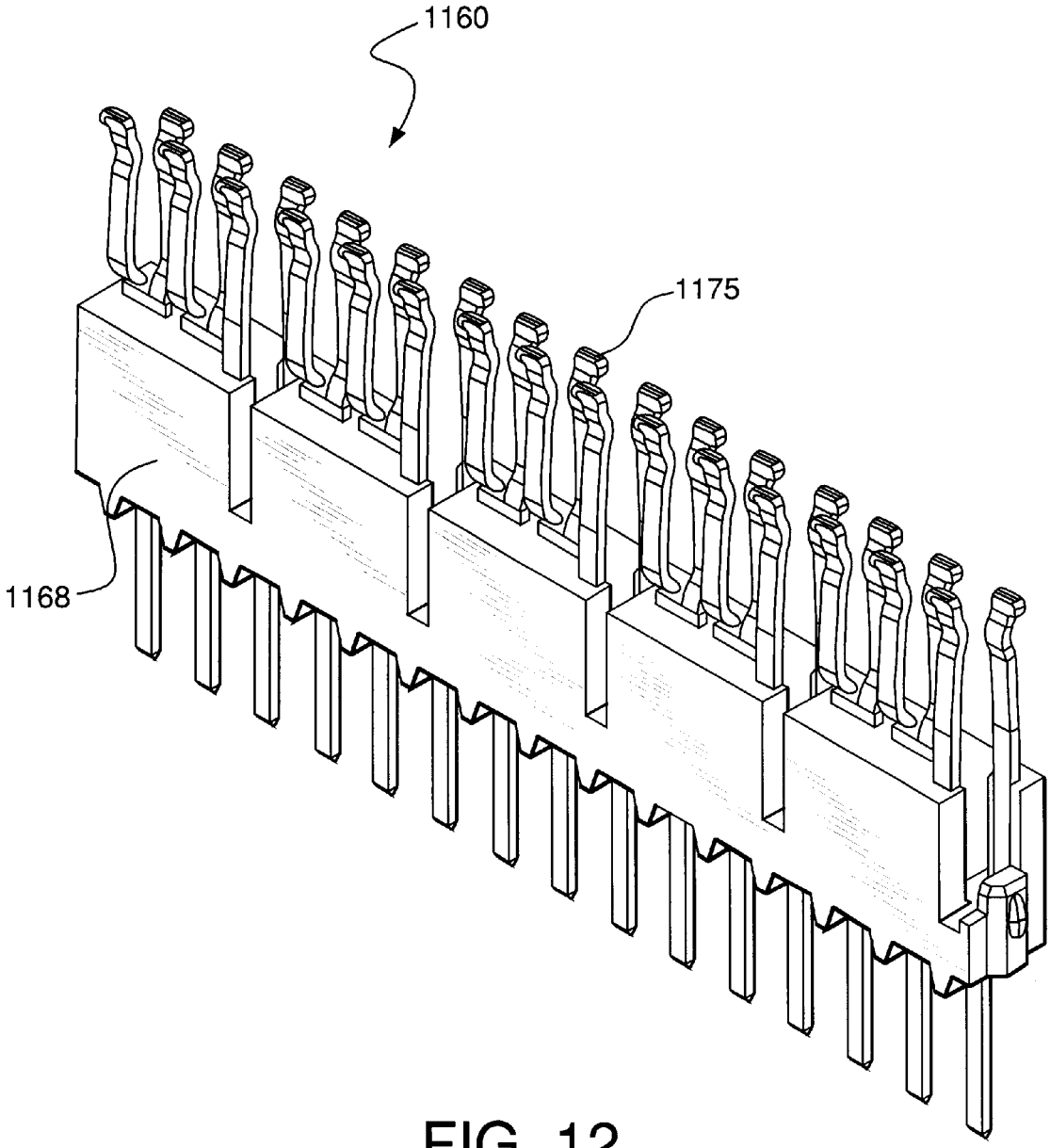
FIG. 12 is a perspective view of a single column of receptacle contacts.
Figure 13:
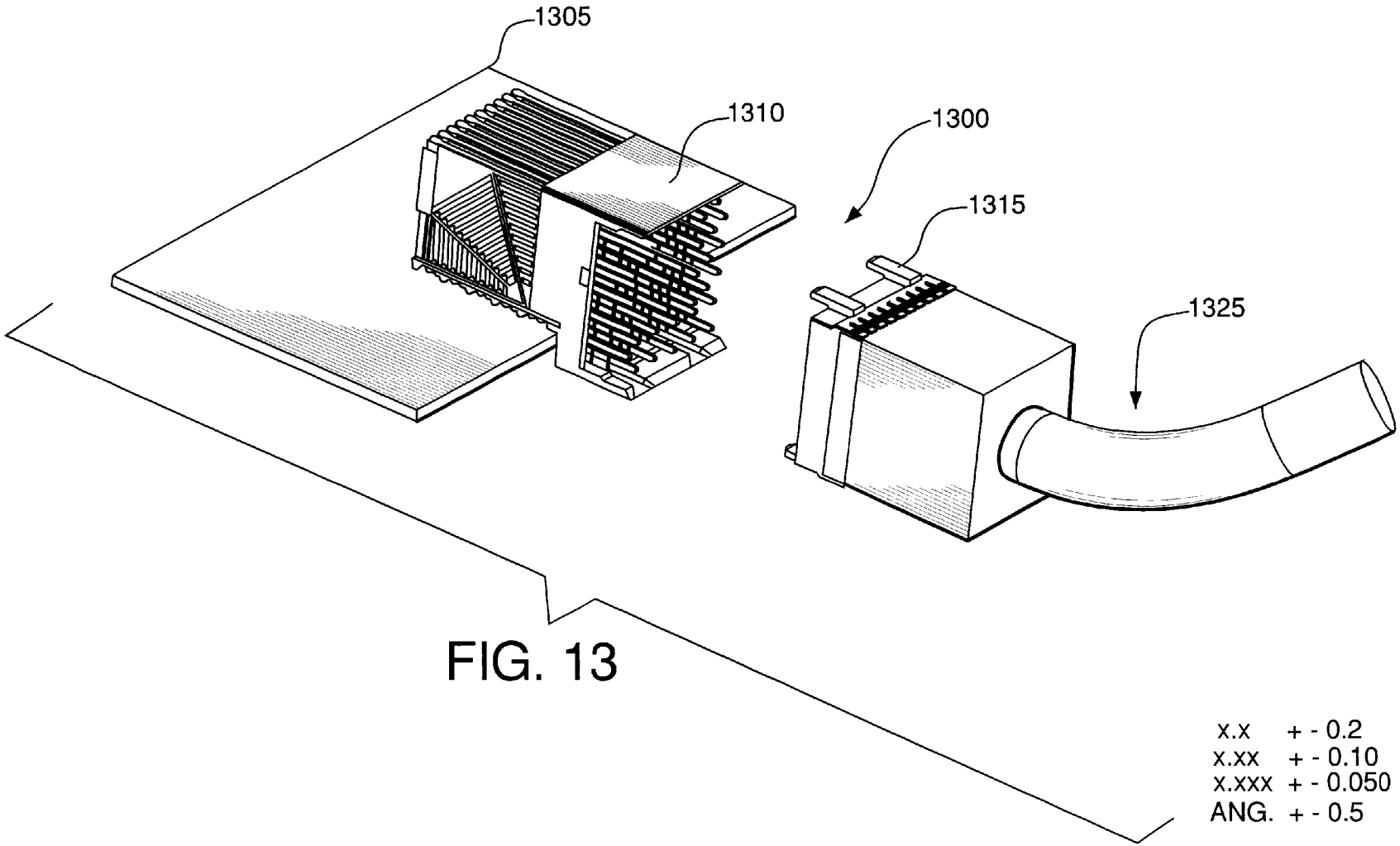
FIG. 13 is a perspective view of a connector in accordance with another embodiment of the invention.

FIG. 12 is a perspective view of a single receptacle contact assembly not contained in receptacle housing 1150. As shown, the assembly 1160 includes a plurality of dual beam conductive terminals 1175 and aholder 1168 made of insulating material. In one embodiment, the holder 1168 is made of plastic injection molded around the contacts; however, any suitable insulating material may be used without departing from the scope of the invention. FIG. 13 is a perspective view of a connector in accordance with another embodiment of the invention. As shown, connector 1310 and receptacle 1315 are used in combination to connect an electrical device, such as circuit board 1305 to a cable 1325. Specifically, when connector 1310 is mated with receptacle 1315, an electrical connection is established between board 1305 and cable 1325. Cable 1325 can then transmit signals to any electrical device (not shown) suitable for receiving such signals.

Figure 14:
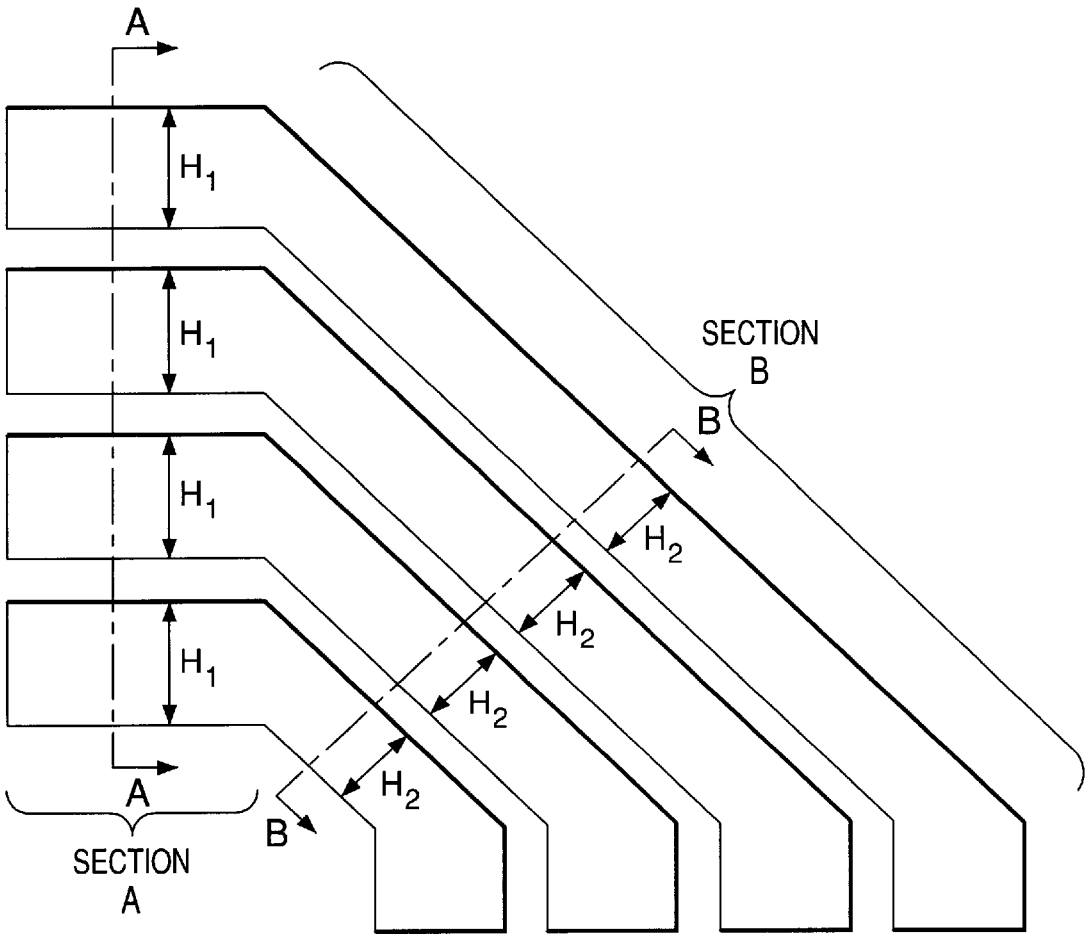
FIG. 14 is a side view of a column of right angle terminals in accordance with another aspect of the invention.

In another embodiment of the invention, it is contemplated that the offset distance, d, may vary throughout the length of the terminals in the connector. In this manner, the offset distance may vary along the length of the terminal as well as at either end of the conductor. To illustrate this embodiment and referring now to FIG. 14, a side view of a single column of right angle terminals is shown. As shown, the height of the terminals in section A is height H1 and the height of the cross section of terminals in section B is height H2.

Figure 15:
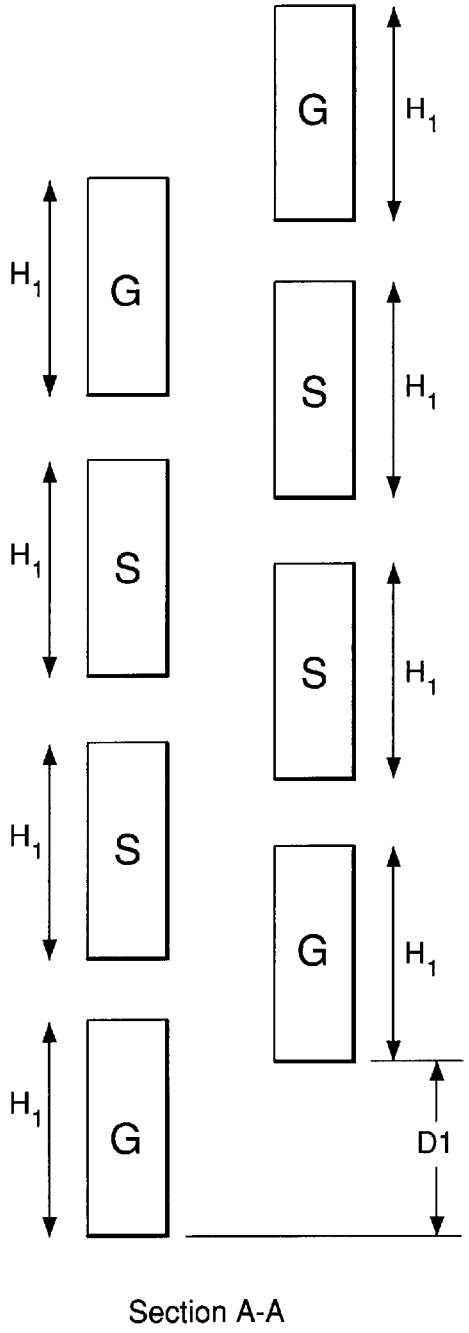
FIG. 15 and FIG. 16 are front views of the right angle terminals of FIG. 14 taken along lines A—A and lines B—B respectively.
Figure 16:
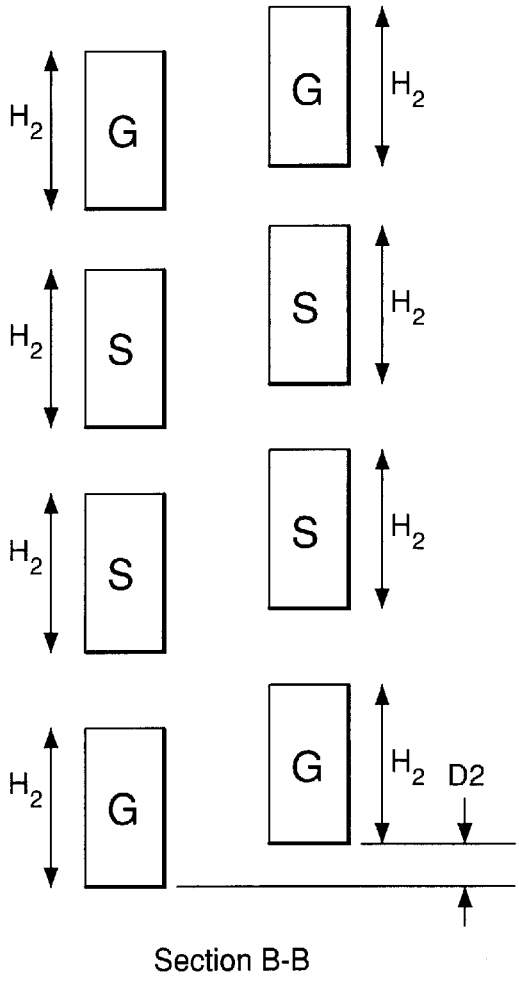

FIG. 15 and FIG. 16 are a front view of the columns of right angle terminals taken along lines A—A and lines B—B respectively. In addition to the single column of terminals shown in FIG. 14, FIG. 15 and FIG. 16 also show an adjacent column of terminals contained in the adjacent lead assembly contained in the connector housing.

In accordance with the invention, the offset of adjacent columns may vary along the length of the terminals within the lead assembly. More specifically, the offset between adjacent columns varies according to adjacent sections of the terminals. In this manner, the offset distance between columns is different in section A of the terminals then in section B of the terminals.

To illustrate and as shown in FIG. 15 and FIG. 16, the cross sectional height of terminals taken along line A—A in section A of the terminal is H1 and the cross sectional height of terminals in section B taken along line B—B is height H2. As shown in FIG. 15, the offset of terminals in section A, where the cross sectional height of the terminal is H1, is a distance D1.

Similarly, FIG. 16 shows the offset of the terminals in section B of the terminal. As shown, the offset distance between terminals in section B of the terminal is D2. In accordance with this configuration, since the offset distance is different along the length of the terminal, the multi-active cross talk that occurs between the terminals is reduced thereby increasing signal integrity.

In another embodiment of the invention, to further reduce cross talk, the offset between adjacent terminal columns is different than the offset between vias on a mated printed circuit board. A via is conducting pathway between two or more layers on a printed circuit board. Typically, a via is created by drilling through the printed circuit board at the appropriate place where two or more conductors will interconnect.

Figure 17:
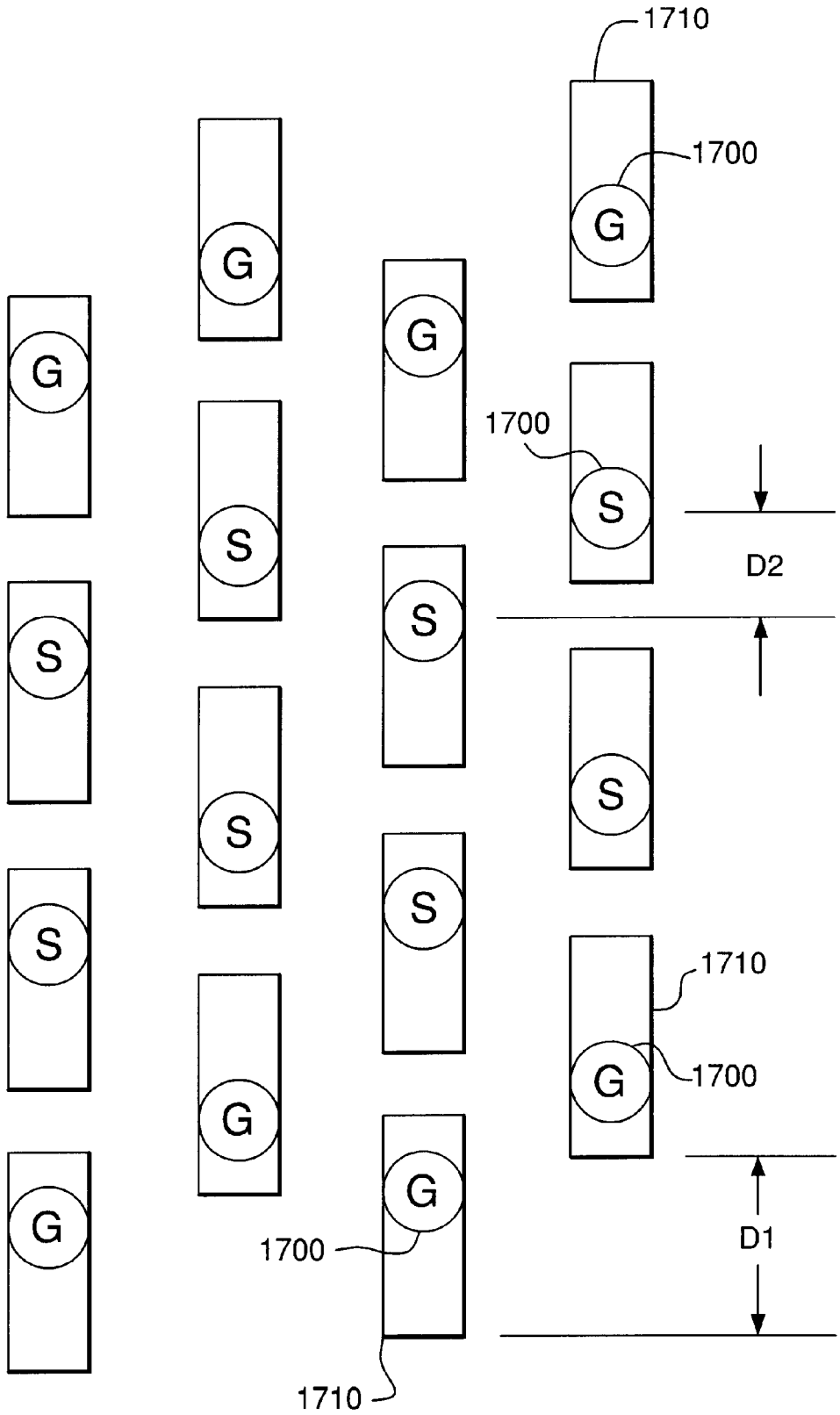
FIG. 17 illustrates the cross section of terminals as the terminals connect to vias on an electrical device in accordance with another aspect of the invention.

To illustrate such an embodiment, FIG. 17 illustrates a front view of a cross section of four columns of terminals as the terminals mate to vias on an electrical device. Such an electric device may be similar to those as illustrated in FIG. 1. The terminals 1710 of the connector (not shown) are inserted into vias 1700 by connection pins (not shown). The connection pins, however, may be similar to those shown in FIG. 2.

In accordance with this embodiment of the invention, the offset between adjacent terminal columns is different than the offset between vias on a mated printed circuit board. Specifically, as shown in FIG. 17, the distance between the offset of adjacent column terminals is D1 and the distance between the offset of vias in an electrical device is D2. By varying these two offset distances in accordance with the invention, the cross talk that occurs in the connector of the invention is reduced and the corresponding signal integrity is maintained.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed is:

1. An electrical connector comprising:

a connector housing;

a plurality of columns of differential contact pairs disposed within the housing, each differential contact pair including a first signal contact for transmitting a signal having a first polarity and a second signal contact for transmitting a signal having a second polarity, opposite to said first polarity; and a plurality of ground contacts wherein a ground contact is disposed between each differential contact pair within each column of differential contact pairs;

wherein each column of differential contact pairs and ground contacts is offset from an adjacent column such that multi-active cross-talk is reduced with respect to each differential contact pair.

2. The electrical connector of claim 1 further comprising:

a ground contact disposed at the top of one column of differential contact pairs and a ground contact disposed at the bottom of an adjacent column of differential contact pairs.

3. The electrical connector of claim 1 wherein the connector is a right angle connector.

4. The electrical connector of claim 1 wherein the connector is a vertical connector.

5. The electrical connector of claim 1 further comprising:

a lead frame, each lead frame containing one column of differential contact pairs and ground contacts.

6. The electrical connector of claim 1 wherein the connector is adapted to pass signals above 1 Gb/s.

7. The connector of claim 1 wherein an aspect ratio of gap to pitch between the columns of differential pairs is less than 0.3.

8. The connector of claim 1 wherein the offset between adjacent columns varies along the length of the differential pair.

9. The connector of claim 1 wherein the offset is a full pitch.

10. The connector of claim 1 wherein said connector housing further comprises separable plug and receptacle housings.

11. The connector of claim 1 wherein no shields are positioned between said columns.

12. The connector of claim 1 wherein no grounds are positioned between said columns.

13. The connector of claim 1, further comprising ground contacts at the top and bottom of at least one of said columns.

14. An electrical system comprising:

a first electrical device;

a second electrical device;

an electrical connector for electrically connecting the first electrical device to the second electrical device, the connector comprising:

a connector housing;

a plurality of columns of differential contact pairs disposed within the housing, each differential contact pair including a first signal contact for transmitting a signal having a first polarity and a second signal contact for transmitting a signal having a second polarity, opposite to said first polarity; and a plurality of ground contacts wherein a ground contact is disposed between each differential contact pair within each column of differential contact pairs;

wherein each column of differential contact pairs and ground contacts is offset from an adjacent column such that multi-active cross-talk is reduced with respect to each differential contact pair.

15. The electrical system of claim 14 wherein one of the first and second electrical devices further comprises:

a plurality of adjacent columns of vias for electrically connecting the device to the connector wherein the adjacent columns of vias are offset from one another by a distance that differs from the offset between columns of differential contact pairs and ground contacts of the connector.

16. An electrical connector comprising:

a plug comprising:

a plurality of columns of differential contact pairs disposed within the plug, each differential contact pair including a first signal contact for transmitting a signal having a first polarity and a second signal contact for transmitting a signal having a second polarity; and a plurality of ground contacts wherein a ground contact is disposed between each differential contact pair within each column of differential contact pairs;

wherein each column of differential contact pairs and ground contacts is offset from an adjacent column such that multi-active cross-talk is reduced with respect to each differential contact pair; and a receptacle electrically connected to the plug comprising:

a second plurality of columns of differential contact pairs disposed within the receptacle, each differential contact pair including a first signal contact for transmitting a signal having a first polarity and a second signal contact for transmitting a signal having a second polarity; and a second plurality of ground contacts wherein a ground contact is disposed between each differential contact pair within each second plurality of columns of differential contact pairs;

wherein each second column of differential contact pairs and ground contacts is offset from an adjacent column such that multi-active cross-talk is reduced with respect to each differential contact pair.

17. The connector of claim 16 wherein the receptacle is adapted to connect to a cable.

18. A plug for an electrical connector comprising:

a housing;

a plurality of lead frames contained within said housing, each said lead frame comprising:

a column of contacts arranged as:

a plurality of differential contact pairs having terminal pins at both ends thereof, each differential contact pair including a first signal contact for transmitting a signal having a first polarity and a second signal contact for transmitting a signal having a second polarity; and a plurality of ground contacts having ground pins at both ends thereof, wherein a ground contact is disposed between each differential contact pair;

wherein said differential contact pairs and ground contacts of each said column are offset from those of an adjacent column such that multi-active cross-talk is reduced with respect to each differential contact pair.

19. The plug of claim 18 wherein no shields are positioned between said lead frames.

20. The plug of claim 19 wherein no grounds are positioned between said lead frames.

21. The plug of claim 18 wherein at least one of said columns of contacts includes a ground contact at the top and bottom of said column.

22. An electrical connector comprising:

a housing;

a plurality of lead frames contained within said housing, each said lead frame comprising:

a column of contacts arranged as:

a plurality of differential contact pairs having terminal pins at both ends thereof, each differential contact pair including a first signal contact for transmitting a signal having a first polarity and a second signal contact for transmitting a signal having a second polarity, opposite from said first polarity; and wherein said differential contact pairs of each said column are offset from those of an adjacent column such that multi-active cross-talk is reduced with respect to each differential contact pair.

* * * * *